US007632112B2

(12) United States Patent
Wakamatsu et al.

(10) Patent No.: US 7,632,112 B2
(45) Date of Patent: Dec. 15, 2009

(54) ELECTRICAL CONTACT COMPONENT, COAXIAL CONNECTOR, AND ELECTRICAL CIRCUIT DEVICE INCLUDING THE SAME

(75) Inventors: Hiroki Wakamatsu, Ishikawa-gun (JP); Yuichi Maruyama, Kanazawa (JP); Nobushige Araki, Toyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 542 days.

(21) Appl. No.: 10/595,698

(22) PCT Filed: Nov. 28, 2005

(86) PCT No.: PCT/JP2005/021817

§ 371 (c)(1),
(2), (4) Date: May 5, 2006

(87) PCT Pub. No.: WO2006/059578

PCT Pub. Date: Jun. 8, 2006

(65) Prior Publication Data

US 2008/0293297 A1 Nov. 27, 2008

(30) Foreign Application Priority Data

Dec. 3, 2004 (JP) ..... 2004-351638

(51) Int. Cl.
*H01R 12/00* (2006.01)

(52) U.S. Cl. ..... 439/83; 439/581; 439/876; 439/944; 428/680; 428/672

(58) Field of Classification Search ..... 439/63, 439/83, 188, 578, 581, 876, 944
See application file for complete search history.

(56) References Cited

U.S. PATENT DOCUMENTS 5,453,017 A * 9/1995 Belopolsky ..... 439/83

(Continued)

FOREIGN PATENT DOCUMENTS

JP 62-199794 A 9/1987

(Continued)

OTHER PUBLICATIONS

Yamamoto et al.; "Reactivity to Form Intermetallic Compounds in the Micro Joint Using Sn-Ag Solder"; MES2003; Oct. 2003; pp. 45-48.

(Continued)

*Primary Examiner*—James Harvey
(74) *Attorney, Agent, or Firm*—Keating & Bennett, LLP

(57) ABSTRACT

An electrical contact component includes a base defining an external terminal to be mounted on a surface of a wiring board with a solder and a fitting portion having a substantially tubular shaped fitting periphery. The external terminal has a first principal surface opposing the surface of the wiring board, a second principal surface substantially parallel to the first principal surface, and sides substantially perpendicular to the first and second principal surfaces and connecting the first principal surface to the second principal surface. The fitting portion is continuously provided on the second principal surface. The fitting periphery of the fitting portion is electrically connected to the second principal surface and the sides of the external terminal by metal layers formed over their respective surfaces. The metal layer contains Ni as a principal constituent and Co, and the metal layer contains Au as a principal constituent.

11 Claims, 3 Drawing Sheets

U.S. PATENT DOCUMENTS

| | | | | |
|---|---|---|---|---|
| 6,261,136 | B1 * | 7/2001 | Dennis | 439/876 |
| 6,399,475 | B1 * | 6/2002 | Petit | 438/614 |
| 6,554,630 | B2 | 4/2003 | Uratani | |
| 6,556,608 | B1 * | 4/2003 | Gilliland et al. | 372/50.1 |
| 7,377,795 | B2 * | 5/2008 | Vicich et al. | 439/83 |
| 2004/0079791 | A1 | 4/2004 | Kida et al. | |
| 2008/0293297 | A1 * | 11/2008 | Wakamatsu et al. | 439/581 |

FOREIGN PATENT DOCUMENTS

| | | | |
|---|---|---|---|
| JP | 62-199795 | A | 9/1987 |
| JP | 04-162460 | A | 6/1992 |
| JP | 08-213070 | A | 8/1996 |
| JP | 09-172124 | A | 6/1997 |
| JP | 09-330629 | A | 12/1997 |
| JP | 10-084065 | A | 3/1998 |
| JP | 10-247535 | A | 9/1998 |
| JP | 2000-087293 | A | 3/2000 |
| JP | 2000-313986 | A | 11/2000 |
| JP | 2000-313992 | A | 11/2000 |
| JP | 2001-176612 | A | 6/2001 |
| JP | 2002-203627 | A | 7/2002 |
| JP | 2003-178844 | A | 6/2003 |
| JP | 3096377 | U | 6/2003 |
| JP | 2004-047827 | A | 2/2004 |

OTHER PUBLICATIONS

Kobayashi et al.; "Rapid Alloying in the Micro Joints Between Sn-Ag Solder and Au/Ni-Co Plating"; MES2004; Oct. 2004; pp. 233-236.

International Search Report issued in the corresponding International Application No. PCT/JP2005/021817, mailed on Dec. 12, 2005.

Official communication issued in counterpart Japanese Application No. 2006-547912, mailed on Nov. 18, 2008.

* cited by examiner

ELECTRICAL CONTACT COMPONENT, COAXIAL CONNECTOR, AND ELECTRICAL CIRCUIT DEVICE INCLUDING THE SAME

BACKGROUND OF THE INVENTION

1. Field of the Invention

The present invention relates to a surface-mount electrical contact component, such as a coaxial connector, and an electrical circuit device including the same.

2. Description of the Related Art

Some of the electrical circuit devices, such as communication devices of cellular phones, conventionally include a signal-switchable surface-mount coaxial connector having a switch. For example, Japanese Unexamined Patent Application Publication No. 2001-176612 (Patent Document 1) discloses one type of coaxial connector.

FIG. 4 shows the general appearance of the surface-mount coaxial connector, and FIG. 5 shows a cross section thereof. The coaxial connector 10 includes an external terminal 2, an input terminal 3, and a fitting portion 4. The external terminal 2 has a first principal surface 11 opposing a wiring board 31, a second principal surface 12 substantially parallel to the first principal surface 11, and a pair of sides 13. The boundary between the second principal surface 12 and the sides 13 is defined by an edge line 14. The external terminal 2 has a base configuration. The fitting portion 4 has a cylindrical shape and is provided on the second principal surface 12 of the external terminal 2 and integrated with the external terminal 2.

The surfaces of the external terminal 2, input terminal 3 and fitting portion 4 are covered with metal films by, for example, plating, and the external terminal 2 and the fitting portion 4 are electrically connected to each other. The metal films each include an underlayer made of a Ni metal film 42 and a surface layer made of a Au metal film 43.

The coaxial connector 10 is surface-mounted on the wiring board 31 with solder. More specifically, the external terminal 2 and the input terminal 3 are electrically connected to predetermined portions of the wiring board 31, thereby achieving the function of the coaxial connector. FIG. 5 is a sectional view of the mounted coaxial connector taken along a plane perpendicular to the sides 13, omitting the internal structure including the input terminal 3.

During use of the coaxial connector 10, the solder 32 applied for surface mounting to connect the external terminal 2 spreads on and rises from the second principal surface 12, and further extends to the fitting portion 4 as shown in FIG. 5. Consequently, fitting failure may occur in the socket of the coaxial cable corresponding to the fitting portion 4. Although it is sufficient for the solder 32 to reach the sides 13 of the external terminal 2, the solder 32 that has risen to the second principal surface 12 easily extends to the fitting portion 4.

The surface mounting of the coaxial connector 10 is generally performed by passing it through a reflow furnace, and this is often repeated several times. Consequently, solder deposited at appropriate locations may be remelted by repeatedly passing through the reflow furnace, and thus, disadvantageously rise and reach the fitting portion 4.

In order to prevent the solder from rising, Japanese Unexamined Patent Application Publication No. 8-213070 (Patent Document 2) discloses a method for forming an oxide coating film over a predetermined region.

In Japanese Unexamined Patent Application Publication No. 10-247535 (Patent Document 3), for the formation of the Au plating surface layer on the Ni plating underlayer, a region in which the Au plating layer is not formed is prepared and the Ni plating layer exposed at this region is oxidized by an alkaline aqueous solution such that the oxidized Ni film prevents the solder from rising.

In Japanese Unexamined Patent Application Publication No. 2002-203627 (Patent Document 4), a metal film having low solder wettability is provided as the underlayer and another metal film having high solder wettability is provided as the surface layer over the underlayer. Then, only a specific region of the metal surface layer is removed by etching, such that the exposed metal film having a low solder-wettability prevents the solder from rising.

Unfortunately, the method disclosed in Patent Document 2 requires the additional step of forming the oxide coating film after the steps of forming the metal films. This disadvantageously increases the complexity of the manufacture process.

In the method disclosed in Patent Document 3, the step of forming a resist layer or a mask layer so as not to form the Au plating film in a specific region is complicated, and the step of oxidation treatment with an alkaline treating agent is also complicated.

In the method disclosed in Patent Document 4, the step of etching by laser exposure is complicated and expensive.

SUMMARY OF THE INVENTION

To overcome the problems described above, preferred embodiments of the present invention prevent fitting failure caused by the rise of solder used for surface mounting of the electrical contact components, such as coaxial connectors, at low cost and without complicated steps.

Accordingly, a preferred embodiment of the present invention provides an electrical contact component including a base to be mounted on a surface of a mounting board with a solder, the base having a first principal surface opposing the surface of the mounting board, a second principal surface substantially parallel to the first principal surface, and sides substantially perpendicular to the first and second principal surfaces and connecting the first principal surface to the second principal surface, and a fitting portion continuously arranged second principal surface, the fitting portion including a fitting periphery having a tubular shape. The fitting periphery of the fitting portion is electrically connected to the second principal surface and the sides of the base by metal films provided over their respective surfaces. The metal films each include a first metal layer including Ni as a principal constituent and Co, and a second metal layer including Au as a principal constituent and overlying the first metal layer.

When the electrical contact component according to preferred embodiments of the present invention is mounted on a board, the constituents (Ni, Co) of the first and the second metal layer diffuse into the solder that has risen along the sides of the base, and chemically react with Sn being the principal constituent of the solder to produce an intermetallic compound. The Co promotes the diffusion of the Ni into the solder. This intermetallic compound prevents the solder from rising to the second principal surface.

Preferably, the base of the electrical contact component defines an external terminal and is integrated with the fitting portion, and the second principal surface is partitioned from the sides by an edge line.

Preferably, the first and the second metal layer are formed by plating or cladding. The Co content in the first metal layer is preferably in the range of about 5 percent to about 80 percent by weight, and more preferably, at least about 10 percent by weight.

The electrical contact component according to preferred embodiments of the present invention may be a coaxial connector having a substantially cylindrical fitting portion provided on the second principal surface of the external terminal.

The coaxial connector and a wiring board on which the base is surface-mounted with a Sn-based solder define an electrical circuit device, such as a communication device.

In the electrical contact component according to preferred embodiments of the present invention, the change of the constituents of the metal film defining the underlayer prevents the solder from excessively rising and the fitting failure of sockets and other components. Accordingly, no complicated step is required, and thus the cost is reduced.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the electrical contact component according to the present invention will now be described using a coaxial connector.

Figure 1:
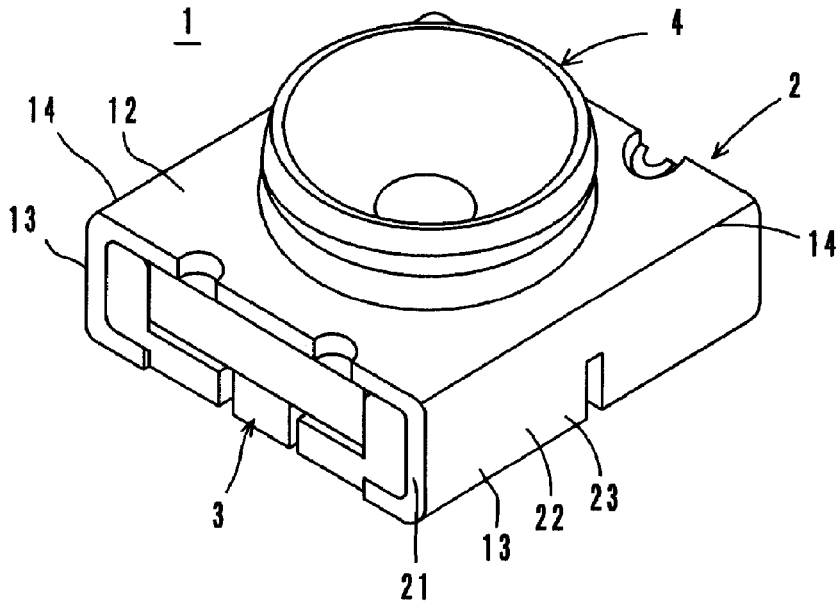
FIG. 1 is a perspective view of a coaxial connector as an example of the electrical contact component according to a preferred embodiment of the present invention.
Figure 2:
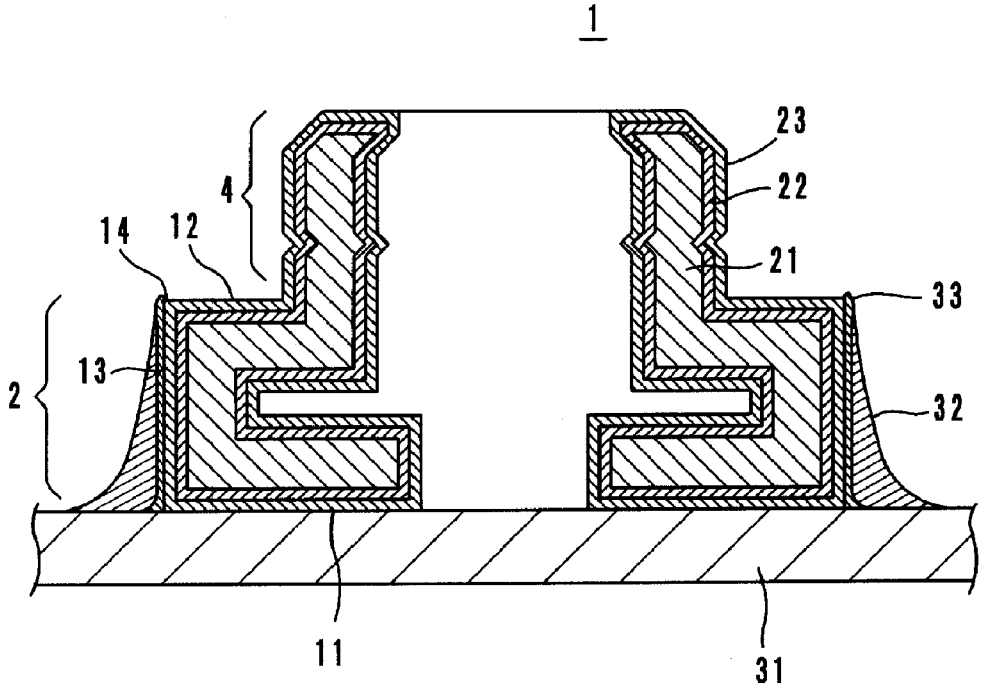
FIG. 2 is a sectional view of the coaxial connector mounted on a wiring board.
Figure 4:
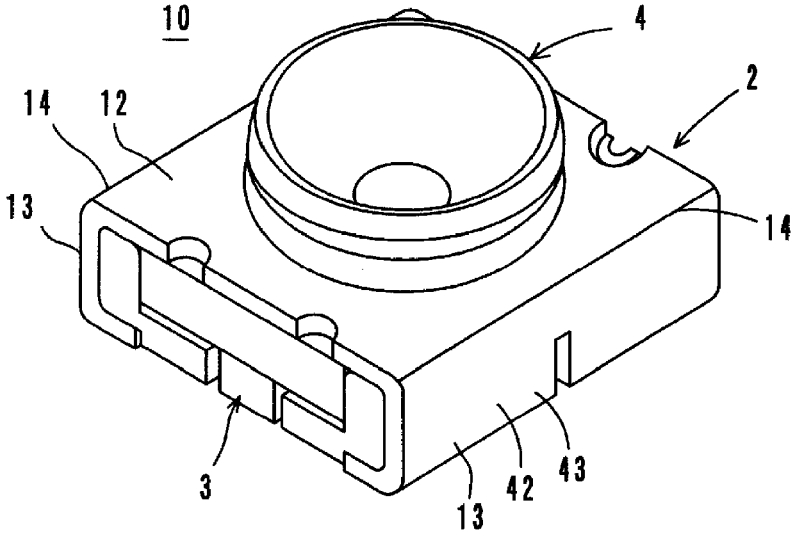
FIG.4 PRIOR ART
FIG. 4 is a perspective view of a known coaxial connector.
Figure 5:
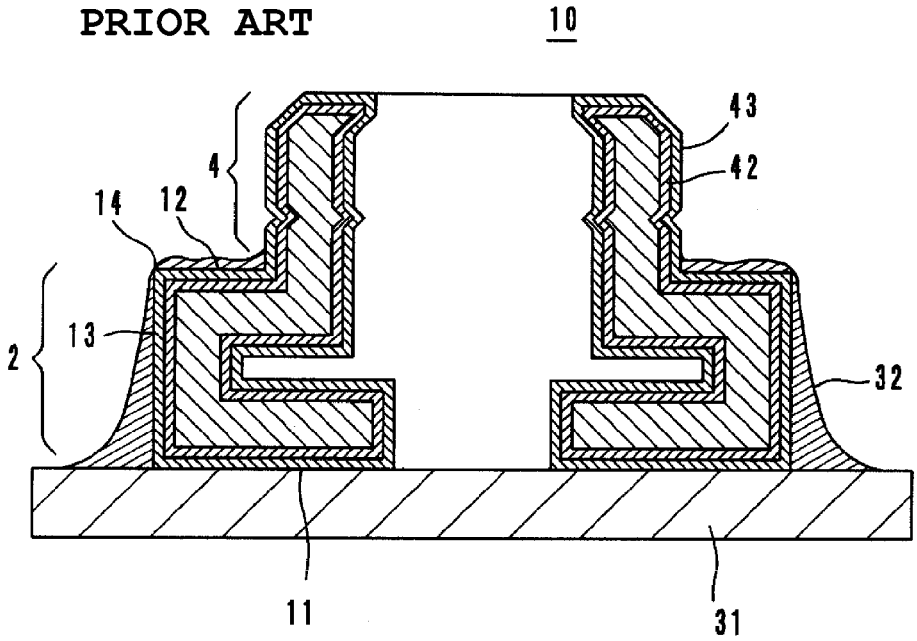
FIG.5 PRIOR ART
FIG. 5 is a sectional view of the known coaxial connector mounted on a wiring board.

FIG. 1 shows the configuration of a coaxial connector 1 according to a preferred embodiment of the present invention, and FIG. 2 shows its cross section. The appearance and the basic structure of the coaxial connector 1 are preferably substantially the same as those of the generally known coaxial connector shown in FIGS. 4 and 5. However, the constituents of the first metal layer 22 defining the underlayer are different.

FIG. 2 is a sectional view of the coaxial connector 1 surface-mounted on a wiring board 31. The section is taken along a plane that is perpendicular to the sides 13 of the external terminal 2, and the input terminal 3 and the internal components of the coaxial connector are not shown.

The coaxial connector 1 includes an external terminal 2, an input terminal 3, and a fitting portion 4. Since the external terminal 2 and the input terminal 3 will be connected to the land of the wiring board 31 with solder 32 for surface mounting on the wiring board 31, they are located in locations that can be brought into contact with the wiring board 31. The external terminal 2 is a base having a first principal surface 11 opposing the wiring board 31, a second principal surface 12 substantially parallel to the first principal surface 11, and a pair of sides 13. For the proper function as the coaxial connector, the external terminal 2 and the input terminal 3 are electrically isolated from each other, and the external terminal 2 and the fitting portion 4 are electrically connected to each other so as to be integrated with each other.

The external terminal 2 is partitioned into the substantially horizontal second principal surface 12 and the sides 13. The words "substantially horizontal" mean that the surface is substantially parallel to the surface of the wiring board 31. This surface is not necessarily precisely parallel, and may be slightly tilted as long as function of the coaxial connector 1 is ensured. The sides 13 have surfaces to be wetted by the solder used for mounting and are physically connected to the wiring board 31. The sides 13 are defined by two opposing faces of the four surfaces that are substantially perpendicular to the substantially horizontal principal surface 12 of the external terminal 2. These two sides 13 may extend to the other two surfaces. The sides 13 are not necessarily precisely perpendicular to the wiring board 31, and may be slightly tilted. The edge line 14 is chamfered.

The fitting portion 4 of the coaxial connector 1 is preferably substantially cylindrical as shown in FIG. 1. However, the fitting portion 4 is not necessarily cylindrical as long as it fits into, for example, a socket. For example, the fitting portion 4 may have a prism-like shape. The fitting portion 4 shown in FIG. 1 protrudes from the second principal surface 12 and its periphery fits in, for example, the socket. The fitting portion may extend downward when the second principal surface 12 has a fitting hole. Also, the fitting portion 4 may be screw-fitted with, for example, the socket.

The surfaces of the external terminal 2, the input terminal 3 and the fitting portion 4 are coated with a metal film. In FIG. 2, first, a first metal layer 22 primarily including Ni is provided as an underlayer over the base material 21 of these portions. Then, a second metal layer 23 primarily including Au is provided as a surface layer. The first metal layer 22 and the second metal layer 23 may be separated by another metal layer. However, the first metal layer 22 and the second metal layer 23 alone are sufficient, and an additional layer is not necessarily required.

The surface layer, or the second metal layer 23, has high solder wettability, and accordingly, the second metal layer primarily includes Au. The Au coating film is not degraded by sulfuration, unlike Ag coating films. A small amount of impurities may be included as long as sufficient solder wettability is obtained.

A preferred embodiment of the present invention includes a constituent of the first metal layer 22. Specifically, the first metal layer 22 includes Ni as a principal constituent and an appropriate amount of Co. Consequently, the first metal layer effectively prevents the solder used for mounting from rising to the second principal surface 12, and further reaching the fitting portion 4, as compared to the known Co-free Ni metal layer, as described below. The first metal layer 22 must have a high adhesion to the second metal layer 23. The Co-containing Ni-based metal layer 22 satisfies this requirement. The first metal layer 22 may include other constituents or impurities.

As for the Co content in the first metal layer 22, if passing through the reflow furnace is performed 3 times, a Co content of less than about 5 percent by weight undesirably results in insufficient prevention of the rising of the solder. Preferably, the Co content is at least about 5 percent by weight. A Co content of 10 percent by weight or more is more preferable and produces a satisfactory effect in preventing the solder from rising, even if the reflow is performed 5 times. However, if the Co content is more than about 80 percent by weight, voids may be formed in the solder fillets which reduce the bonding strength.

The base material 21 of the external terminal 2, the input terminal 3 and the fitting portion 4 can be made of, but are not limited to, metal, resin, or ceramic. If the base material 21 is primarily made of Ni containing Co, the base material 21 produces the same effect as the first metal layer 22.

The process for manufacturing the coaxial connector 1 will now be described. In this section, only the formation of the first metal layer 22 and the second metal layer 23 will be described. The coaxial connector 1 is manufactured using the same process as the known coaxial connector, except for the formation of the first metal layer 22 and the second metal layer 23.

One of the techniques for forming the first metal layer 22 and the second metal layer 23 is plating, which is a conventional process. If the base material 21 is made of a metal, electrolytic plating is preferably used. First, a bare base material 21 and an electrically conductive medium are placed in a plating bath containing Ni and Co ions, and a current is applied to deposit Ni and Co over the surface of the base material 21, with the plating bath stirred. A Ni metal layer containing Co, that is, the first metal layer 22, is thus formed. Then, the resulting base material is placed in a plating bath containing Au ions and a current is applied to form a Au metal layer, that is, the second metal layer 23, over the surface of the first metal layer 22, with the plating bath stirred.

The above-described plating may be performed by electroless plating. For example, a bare base material 21 is placed in a plating bath containing Ni and Co ions. A reducing agent in the plating bath causes a reduction reaction such that Ni and Co are deposited over the surface of the base material 21 to form the first metal layer 22. Then, the resulting base material is placed in a plating bath containing Au ions. The difference between the Ni and Co immersion potential and the Au deposition potential causes a substitution reaction, and consequently forms a Au metal layer, that is, the second metal layer 23, over the surface of the first metal layer 22.

The first metal layer 22 and the second metal layer 23 may be formed by cladding. First, a plate being the base material 21 and a Ni plate containing Co are laid over each other and pressed and rolled to be integrated, thus forming a clad material. The clad material is pressed into the form shown in FIG. 1 such that the Co-containing Ni layer defines the surface.

Thus, the surface of the base material 21 is covered with the first metal layer 22. Subsequently, the Au-based second metal layer 23 is formed by the above-described plating. Thus, a coaxial connector having the same structure as that manufactured by the above-described plating is produced.

The clad material may include three layers expressed by base material/Co-containing Ni/Au. In this instance, no Au plating step is required. Cladding can reduce the variation in Co content to a greater extent than plating, and accordingly, the variation of solder rising are reduced. Furthermore, cladding makes the plating step unnecessary or reduces the number of required plating steps. Thus, negative effects on environment are advantageously reduced.

If the base material 21 includes the same constituents as the first metal layer 22, the first metal layer 22 does not need to be provided separately by plating or cladding and only the second metal layer 23 may be formed.

The following will describe the phenomenon produced when the coaxial connector 1 is surface-mounted on a wiring board 31, and a mechanism for preventing the solder from rising, with reference to FIG. 2.

When the coaxial connector 1 is surface-mounted on a wiring board 31 with solder 32, a heating step is performed using a reflow furnace or other suitable heating device. The solder 32 is melted and solidified, such that the coaxial connector 1 is electrically and mechanically connected to the wiring board 31. How the solder 32 wets the sides 13 of the external terminal 2 will now be described. The solder 32 forms fillets at the sides 13 as shown in FIG. 2 to bond to the wiring board 31. The solder primarily includes Sn.

When the Sn-based solder is heated to melt and wets the sides 13, the constituents of the first metal layer 22 and second metal layer 23 forming the surface of the sides 13 diffuse into the solder 32. In particular, the constituents of the first metal layer 22, that is, Ni and Co, diffuse into the solder 32 and react with the Sn in the solder 32 to produce an intermetallic compound 33 of Sn/Ni or Sn/Ni/Co. The Co promotes the diffusion of Ni into the solder 32.

The intermetallic compound 33 has a higher melting point than the Sn-based solder 32, and is difficult to remelt even by repeatedly passing through a reflow furnace. The intermetallic compound 33 therefore blocks the flow of the solder 32 melted or remelted in the vicinity of the edge line 14, and thus, prevents the solder 32 from rising to the second principal surface 12. Thus, the solder 32 does not reach the fitting portion 4.

If a Pb-free Sn—Ag-based solder is used as the solder 32, the temperature of the heating step must be higher because the melting point of the Pb-free Sn—Ag-based solder is at least 40° C. higher than that of Sn—Pb-based solder or conventionally used eutectic solder. Higher temperature promotes the diffusion of the Ni, and further enhances the effect of Co of promoting the diffusion of the Ni. This effect prevents the solder from rising more effectively.

The intermetallic compound 33 does not reduce the bonding strength between the coaxial connector 1 and the wiring board 31.

Accordingly, the coaxial connector 1 prevents fitting failure resulting from excessive rise of solder at low cost without complicated process steps, by adding Co to the Ni-based first metal layer 22.

The electrical contact component according to preferred embodiments of the present invention that is surface-mounted on the wiring board is useful for electrical circuit devices, such as communication devices.

Examples of the electrical contact component according to the present invention will now be described, using coaxial connectors having the same structure as in FIGS. 1 and 2.

First, a plate primarily made of brass was pressed to form a test piece of the coaxial connector having the external terminal 2, the input terminal 3, and the fitting portion 4. The details for designing and forming the structure shown in FIG. 1, which are the same as in the general method as disclosed in Patent Document 1, are omitted.

The bare pressed base material 21 and an electroconductive medium were placed in a plating bath containing Ni and Co ions, and a current was applied to form the first metal layer 22 over the surface of the base material 21, with the plating bath being stirred. The amounts of Ni and Co ions in the plating bath were controlled such that the Co content x by weight in the first metal layer 22 would be the values shown in Table 1. The thickness was about 1.2 μm.

Then, the test piece having the first metal layer 22 was placed in a plating bath containing Au ions, and a Au film defining the second metal layer 23 was formed over the first metal layer 22 with the plating bath being stirred. The thickness was about 0.1 μm. The test pieces of the coaxial connector 1 were thus completed.

TABLE 1

| Test piece No. | 1 | 2 | 3 | 4 | 5 | 6 |
|---|---|---|---|---|---|---|
| Co content by weight in first metal layer | 0 | 5 | 10 | 15 | 20 | 25 |

Each resulting coaxial connector shown in Table 1 was disposed on a wiring board with a solder having a composition of Sn-3.0Ag-0.5Cu, and was passed through a reflow furnace having a peak temperature of about 250° C. five times for surface mounting. The rise of the solder after the third passing and the fifth passing through the reflow furnace was observed through a magnifying glass. Also, the shearing strength was measured by applying a pressure to the first principal surface 11 of the test piece after mounting in the direction parallel to the surface of the wiring board 31 with a push-pull gage. The results are shown in Table 2.

TABLE 2

| Test piece No. | 1 | 2 | 3 | 4 | 5 | 6 |
|---|---|---|---|---|---|---|
| Was there fitting failure by solder rising after 3 cycles of passing through reflow furnace? | Yes | No | No | No | No | No |
| Was there fitting failure by solder rising after 5 cycles of passing through reflow furnace | Yes | Yes | No | No | No | No |
| Shearing strength after 5 cycles of passing through reflow furnace | 17.9 (1.1) | 21.5 (1.6) | 19.7 (2.4) | 18.7 (1.6) | 20.8 (1.2) | — |

Each shearing strength is the average derived from 5 test pieces, and the values in the parentheses represent standard deviations $\sigma_{n-1}$.

In test piece No. 1 having an x value of less than about 5%, which is a comparative example, the solder 32 rose and reached the fitting portion 4 of the coaxial connector 1 after three cycles and after five cycles of the passing through the reflow furnace.

In test piece No. 2 having an x value of about 5%, which is an example of one of the preferred embodiments of the present invention, the solder 32 was prevented from rising after three cycles of the passing through the reflow furnace, but the solder 32 rose and reached the fitting portion 4 of the coaxial connector 1 after five cycles of the passing through the reflow furnace.

In test piece Nos. 3, 4, 5, and 6 having x values of about 10% to about 25%, which are examples of preferred embodiments of the present invention, the solder 32 was prevented from rising to reach the fitting portion 4 after three cycles and after five cycles of the passing through the reflow furnace.

Figure 3:
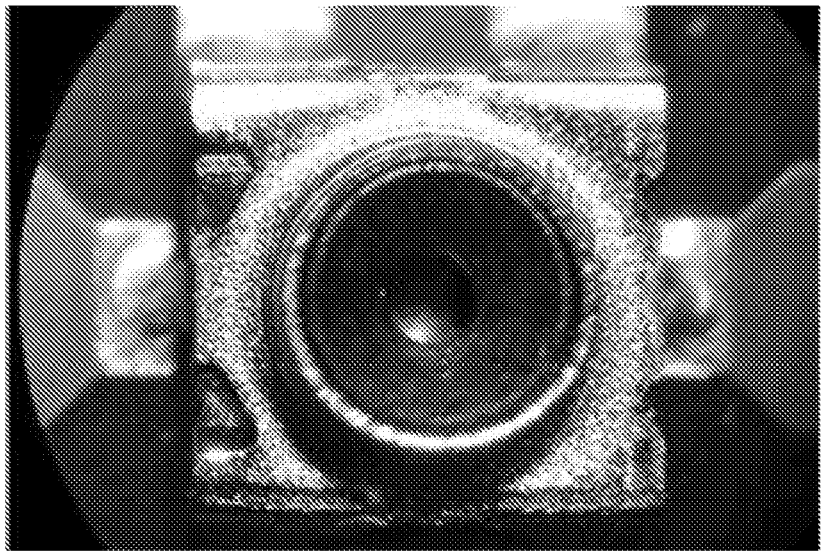
FIG. 3 is a photograph of a mounted test piece in a preferred embodiment of the present invention, viewed from above.
Figure 6:
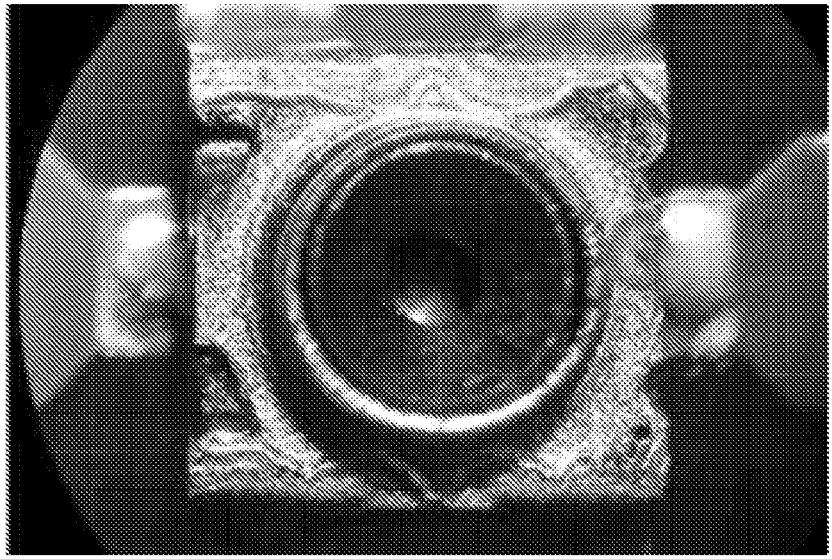
FIG.6 PRIOR ART
FIG. 6 is a photograph of a mounted test piece in a comparative example, viewed from above.

FIGS. 3 and 6 are photographs showing the states of the risen solders after five cycles of the passing through the reflow furnace of test piece No. 5 as an example of one of the preferred embodiments of the present invention and test piece No. 1 as the comparative example, respectively.

The shearing strengths after mounting of test piece Nos. 2 to 6 being the examples of preferred embodiments of the present invention compared advantageously with the shearing strength of test piece No. 1.

Although the preferred embodiments and the examples disclosed above illustrate a coaxial connector having a substantially cylindrical fitting portion, the electrical contact component according to the present invention is not limited thereto.

As described above, the present invention is useful for surface-mount electrical contact components, such as coaxial connectors, and electrical circuit devices using such electrical contact components. In particular, the present invention is advantageous in preventing solder used for surface mounting from rising to cause fitting failure.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. An electrical contact component comprising:

a base to be mounted on a surface of a mounting board with a solder, the base having a first principal surface opposing the surface of the mounting board, a second principal surface substantially parallel to the first principal surface, and sides substantially perpendicular to the first and second principal surfaces and connecting the first principal surface to the second principal surface; and a fitting portion continuously provided on the second principal surface, the fitting portion having a substantially tubular shaped fitting periphery; wherein the fitting periphery of the fitting portion is electrically connected to the second principal surface and the sides of the base by metal films provided over their respective surfaces;

the metal films each include a first metal layer containing Ni as a principal constituent and Co, and a second metal layer containing Au as a principal constituent and overlying the first metal layer; and the Co content in the first metal layer is in the range of about 10% to about 25% by weight.

2. The electrical contact component according to claim 1, wherein the base defines an external terminal and is integrated with the fitting portion, and the second principal surface is partitioned from the sides by an edge line.

3. The electrical contact component according to claim 1, wherein at least one of the first metal layer and the second metal layer is provided by plating.

4. The electrical contact component according to claim 1, wherein the first metal layer is provided by cladding.

5. The electrical contact component according to claim 1, wherein both of the first metal layer and the second metal layer are provided by cladding.

6. The electrical contact component according to claim 1, wherein the fitting portion has a substantially cylindrical shape and protrudes from the second principal surface.

7. A coaxial connector comprising the electrical contact component according to claim 1.

8. An electrical circuit device comprising:

the electrical contact component according to claim 1; and a wiring board on which the base is surface-mounted with a Sn-based solder.

9. The electrical circuit device according 8, wherein the Sn-based solder includes Ag and substantially no Pb.

10. An electrical circuit device comprising:

the coaxial connector according to claim 6; and a wiring board on which the base is surface-mounted with a Sn-based solder.

11. The electrical circuit device according to claim 10, wherein the Sn-based solder includes Ag and substantially no Pb.

* * * * *

UNITED STATES PATENT AND TRADEMARK OFFICE

CERTIFICATE OF CORRECTION

PATENT NO. : 7,632,112 B2
APPLICATION NO. : 10/595698
DATED : December 15, 2009
INVENTOR(S) : Wakamatsu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 766 days.

Signed and Sealed this

Second Day of November, 2010

David J. Kappos

David J. Kappos
*Director of the United States Patent and Trademark Office*